United States Patent [19]

Patterson

[11] 4,108,330

[45] Aug. 22, 1978

[54] EASY OPEN CONTAINER END ASSEMBLY

[75] Inventor: Richard A. Patterson, Woodbury, Minn.

[73] Assignee: Minnesota Mining and Manufacturing Company, St. Paul, Minn.

[21] Appl. No.: 804,581

[22] Filed: Jun. 8, 1977

[51] Int. Cl.[2] ..... B65D 41/02

[52] U.S. Cl. ..... 220/260; 229/7 R; 220/269; 220/270

[58] Field of Search ..... 220/260, 258, 259, 265, 220/266, 268, 269, 270; 229/7 R; 222/541

[56] References Cited

U.S. PATENT DOCUMENTS

| | | | |
|---|---|---|---|
| 3,687,352 | 8/1972 | Kalajian | 229/7 R |
| 3,883,034 | 5/1975 | Rausing | 220/269 X |
| 3,977,562 | 8/1976 | Wedzik | 220/266 X |
| 3,990,603 | 11/1976 | Brochman | 220/260 |

*Primary Examiner*—William Price
*Assistant Examiner*—Steven M. Pollard
*Attorney, Agent, or Firm*—Cruzan Alexander; Donald M. Sell; William L. Huebsch

[57] ABSTRACT

A container end assembly comprising a sheet metal container end having a generally U-shaped cut defining three sides of an openable aperture in the end assembly. A tongue-like portion of the container end projects between the sides and toward the base of the U-shaped cut and a tape is adhered over the U-shaped cut and tongue-like portion. The tape may be manually peeled back to open the aperture in the container end assembly during which the tongue-like portion remains adhered to the tape and bends back with it. The bent tongue-like portion holds the peeled tape closely adjacent the container end away from the nose of a person drinking through the opening, and adhesion between the tape and bent tongue-like portion restricts separation of the tape from the container end.

14 Claims, 13 Drawing Figures

EASY OPEN CONTAINER END ASSEMBLY

BACKGROUND OF THE INVENTION

This invention relates to container end assemblies of the type comprising a container end having an opening covered by a length of tape that may be manually peeled away to uncover the opening so that the contents of a container to which the assembly is attached may be removed; and in one aspect to such a container end assembly for use on cans containing contents under pressure such as carbonated beverages.

U.S. Pat. No. 3,990,603 issued Nov. 9, 1976 to W. R. Brochman describes a container end assembly comprising a container end having an opening, a tape adhered to the outer surface of the container end circumjacent and extending over the opening, and a sheet adhered to the inner surface of the container end circumjacent and extending over the opening with the sheet being adhered to the tape through the opening. Properties are described for each of the components so that the assembly can be used to seal a pressurized container such as a can containing soda pop or beer, while permitting the tape and the portion of the sheet adhered thereto to be manually peeled from over the opening so that the contents of the container can be removed.

While the container end assembly of U.S. Pat. No. 3,990,603 provides a secure seal for carbonated beverages, it presents certain problems in production and use which preferably would be avoided.

First, to restrict the user from peeling the tape entirely off the container end and possibly littering with the tape, it has been necessary to use a more aggressive adhesive between one end of the tape and the container end than is used to adhere the tape over the opening. Application of this more aggressive adhesive presents production problems and adds to the cost of the container end assembly.

Secondly, the tape has sufficient resilience that after it has been peeled from over the opening it projects outwardly from the container end and, unless held out of the way, annoyingly contacts the face of an individual drinking from the container.

SUMMARY OF THE INVENTION

The present invention provides a container end assembly suitable for use on a pressurized container and including a container end with a tape adhered to its outer surface which may be peeled away to open an aperture in the assembly, in which the tape will remain securely adhered to the container end after it is peeled away by the same adhesive used to adhere it over the aperture, and in which the peeled tape will be retained closely adjacent the container end to restrict its annoyance of a person drinking through the aperture.

According to the present invention there is provided a container end assembly comprising a container end of flexible sheet material which takes a permanent set when substantially folded. The container end has a generally U-shaped cut defining three sides of the openable aperture, and includes a tongue-like portion projecting between the sides and toward the base of the U-shaped cut, with the U-shaped cut and the tongue-like portion defining a through opening in the can end. A tape is adhered to the exterior of the container end circumjacent and completely covering the opening and U-shaped cut, with the end of the tape adjacent the base of the U-shaped cut being unadhered and having a tab adapted for manual engagement.

The tape is peelable from over the opening by manually pulling the tab over the tape, and means are included for attaching the distal end part of the tongue-like portion to the tape to cause the distal end part to remain attached to the tape and for affording bending of the part of the tongue-like portion between its distal end part and its proximal end back with the tape during such peeling. When it is bent, the tongue-like portion takes a permanent set to hold the peeled tape closely adjacent the can end, and adhesion between the tape and bent tongue-like portion (which is in shear with respect to forces exerted to further peel the tape) restricts separation of the tape from the container end.

Additionally the tongue-like portion is believed to assist in restricting bulging of the tape over the opening due to pressure in a container to which the container end assembly is attached, and allows the use of an elongate aperture which has a generally uniform width, thereby affording ease of drinking liquid through the aperture. Preferably the means for attaching the distal end part of the tongue-like portion to the tape so that the tongue-like portion stays with the tape as it is peeled away comprises a large distal end part to cause a large adhesive force between the distal end part and the tape, and a portion of a sheet adhered over the U-shaped cut on the inner surface of the container end and adhered to the adjacent surface of the tape through the opening, which portion separates along the cut and stays with the tape sandwiching the tongue therebetween as the tape is peeled away; and the means for affording bending of the tongue-like portion back with the tape during such peeling comprises part of the tongue-like portion between its distal end part and its proximal end which has a lesser width than its distal end part so that it may be easily bent with the tape.

Alternatively, however the entire tongue-like portion may be sufficiently narrow in width so that it may be easily bent with the tape, and the means for attaching the distal end part to the tape may comprise a stiff pad secured between the sheet and the distal end part of the tongue-like portion; or the tongue-like portion may have a large distal end part with a uniform width along its length with the means for affording bending of the tongue-like portion being provided by portions of the tongue-like portion of a reduced thickness between its distal end part and its proximal end.

BRIEF DESCRIPTION OF THE DRAWING

The invention will be further described with reference to the accompanying drawing wherein like parts are similarly numbered in the several views, and wherein.

DESCRIPTION OF THE PREFERRED EMBODIMENT

Figure 1:
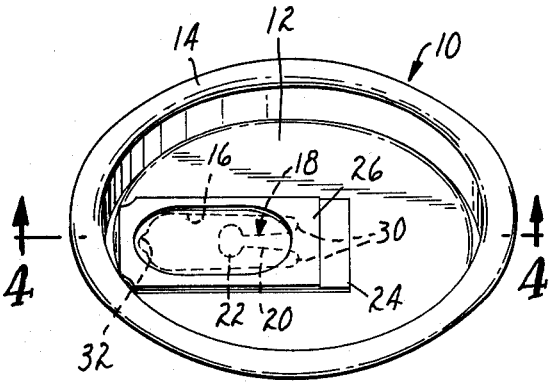
FIG. 1 is a perspective view of a preferred embodiment of a container end assembly according to the present invention.
Figure 2:
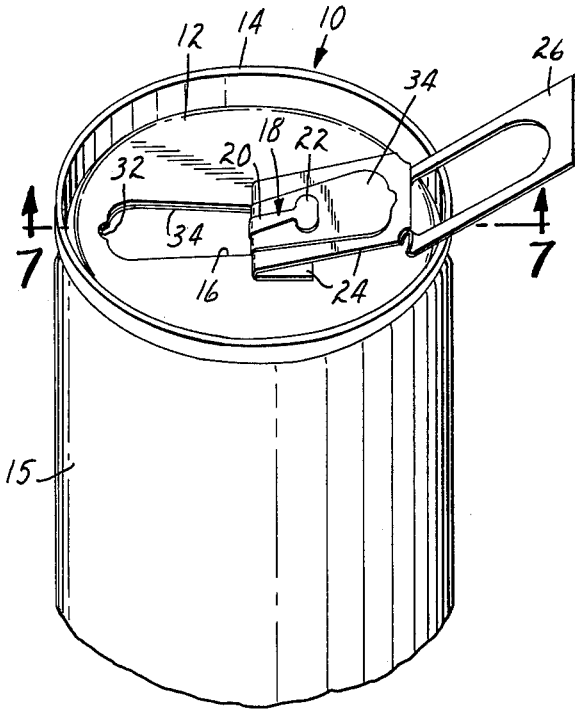
FIG. 2 is a perspective view of the container end assembly of FIG. 1 attached to a container and shown with a tape in the assembly being peeled back to open the assembly.
Figure 3:
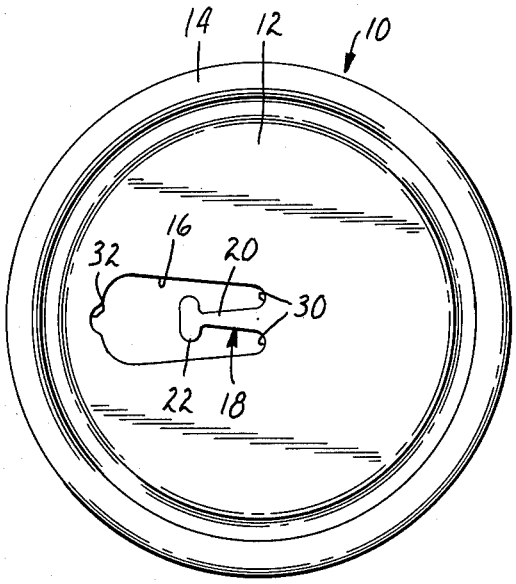
FIG. 3 is a plan view of a container end in the assembly of FIG. 1.
Figure 4:
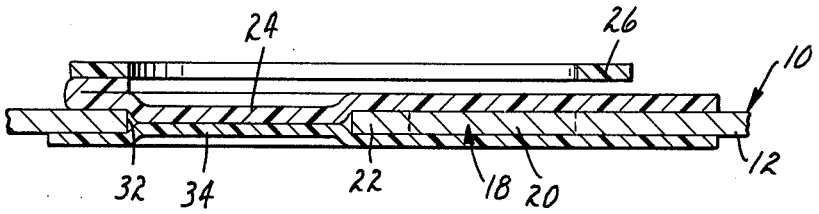
FIG. 4 is an enlarged fragmentary sectional view taken approximately along line 4—4 of FIG. 1.

Referring now to FIGS. 1 through 7 of the drawing, there is shown a preferred embodiment of a container end assembly according to the present invention generally designated by the reference numeral 10.

The container end assembly 10 comprises a container or can end 12 (best seen in FIG. 3) of flexible sheet material or metal which takes a permanent set when substantially folded (e.g. 0.013 inch thick single reduced tin free steel) and has a circular flange 14 adapted to be attached to the end of a cylindrical container or can 15 in a conventional manner. Also the can end 12 has a generally U-shaped cut 16 defining three sides of an openable aperture in the container end assembly 10, and includes a necked tongue-like portion 18 (called the tongue 18 herein) comprising an enlarged distal part 22 and a necked part 20 of reduced width between its distal part 22 and its proximal or attached end. The tongue 18 projects generally radially outwardly of the can end 12 between the sides and toward the base of the U-shaped cut 16. A tape 24 is adhered to an exterior surface of the can end 12 in a position circumjacent and completely covering the cut 16. The end of the tape 24 adjacent the base of the U-shaped cut 16 (i.e. adjacent the flange 14) is not adhered to the can end 12 and has adhered thereto a tab or loop 26 adapted for manual engagement.

Also, as taught in U.S. Pat. No. 3,990,603 (the content whereof is incorporated herein by reference), the container end assembly 10 includes a thin transparent sheet 34 of polymeric material firmly adhered to the inner surface of the can end 12 circumjacent and completely covering the opening 16. Portions of the sheet 34 are adhesively secured to the opposed adjacent surface of the tape 24 around and over the tongue 18 through an opening in the can end 12 between the cut 16 and tongue 18. This interior sheet 34 can serve to protect the edge of the can along the cut 16 and tongue 18 from the contents of a container (which may be important if plating over the balance of the can end 12 is interrupted in this area and the contents of the can will chemically react with the unplated metal of the can end 12).

Figure 5:
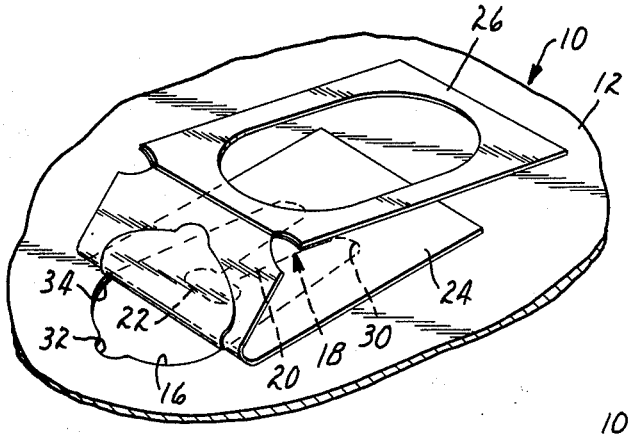
FIGS. 5 and 6 are enlarged fragmentary perspective views of the container end assembly of FIG. 1, but shown in different partially open conditions.
Figure 6:
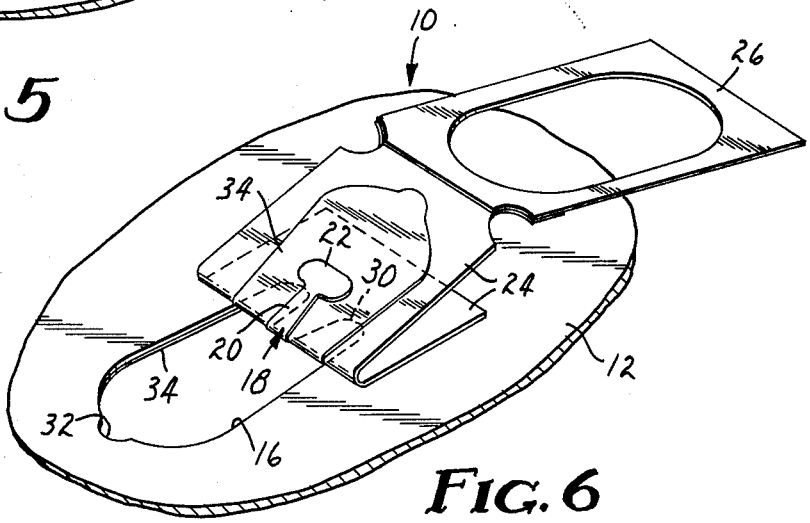
Figure 7:
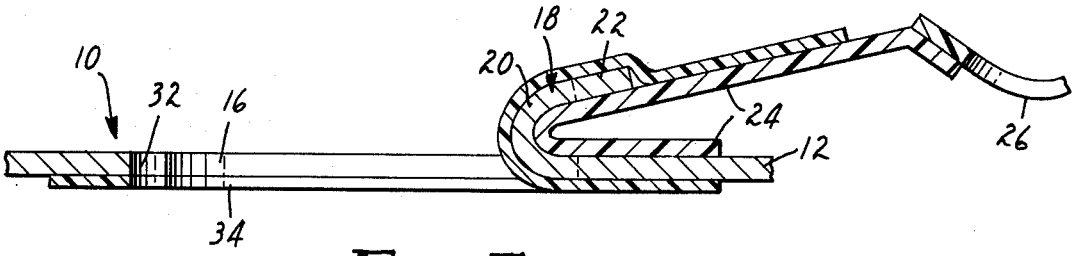
FIG. 7 is an enlarged fragmentary sectional view taken approximately along line 7—7 of FIG. 2.

Removal of the tape 24 from over the cut 16 (such as would be done to open a can to which the end assembly 10 was attached) is illustrated in FIGS. 5 through 7. The tab 26 is manually engaged and pulled back over the adhered portion of the tape 24 to initiate peeling of the tape 24 from the can end 12 beginning with the end of the tape 24 adjacent the base of the U-shaped cut 16. The sheet 34 is adapted to separate along the edges of the opening 16 so that the portion adhered to the tongue 18 and tape 24 will be removed when the tape 24 is peeled away. When the portions of the tape 24 being peeled flank the distal part 22 of the tongue 18, engagement of the adhesive on the tape 24 with the large surface of the tongue's distal part 22 and the sandwiching of the distal part 22 between the tape 24 and the portion of the sheet 34 provide means for attaching the distal part 22 to the tape so that it will remain attached to the tape 24 and will be lifted with it while the necked part 20 of the tongue 18 bends with the tape being peeled away (FIG. 6). Opening of the container end assembly is completed when the portions of the tape 24 being peeled away reach the proximal or attached end of the tongue 18 (FIGS. 2 and 7), whereupon essentially the entire tongue 18 projects away from the opening 16 in a position closely spaced from the outer surface of the can end 12, and has taken a permanent set to hold a major portion of the peeled away tape 24 therebetween so that the tape 24 will not project a great distance normal to the outer surface of the can end 12. Also, since further tension on the tab 26 places the adhesive bond between the tongue 18 and tape 24 in shear, the tape cannot easily be pulled from the tongue 18 so that separation of the tape 24 from the can end 12 is restricted. Also the loop 26 is adapted to have a strength such that, while it provides an effective grip to peel the tape from over the cut 16, it will break and provide an ineffective grip before it can transmit sufficient force to pull the tape from the bent tongue 18.

As illustrated in FIG. 1 the necked part 20 of the tongue 18 preferably increases in width toward its attached end. This makes it more difficult for a person to break the tongue 18 from the rest of the can end 12 by repeatedly bending it back and forth, and to then peel the tape 24 entirely off of the can end 12. The opening 16 preferably is generously radiused adjacent the point of attachment for the tongue 18 in the areas designated 30 to restrict stress concentration points which, if present, could cause fracturing of the can end 12 as a result of internal can pressure. Also the edges of the distal part 22 are preferably spaced from the adjacent edges of the opening 16 to limit the peeling effect that lifting of the tongue 18 due to pressure in a can can have on adjacent adhered portions of the tape 24.

Additionally as taught in U.S. Pat. No. 3,990,603, the cut 16 preferably includes a relative narrow arcuate portion 32 extending toward the flange 14 of the can end 12. The portion 32 will be the first part of the cut 16 uncovered when the tape 24 is peeled away, and, when that occurs, provides a small pressure relief aperture which will allow a safe and relatively quiet release of pressure from inside a container.

EXAMPLE

The following is an illustrative example of a container end assembly of the type illustrated in FIGS. 1 through 5.

A 209 size steel can end 12 of 0.013 inch thick single reduced tin free steel is die formed with a generally U-shaped cut 16 and an opening defining a tongue 18, with the opening having an overall length of about one inch, an arcuate portion 32 having a radius of about 0.078 inch, a maximum width adjacent the flange 14 of about 0.5 inch, and a width adjacent the base of the tongue 18 of about 0.375 inch. The tongue 18 has a length of about 0.5 inch, a radiused distal part 22 having a width of about 0.25 inch and a length of about 0.125 inch; and a necked part 20 having a width of about 0.06 inch adjacent the distal part 22 which is tapered outwardly to smoothly join a radius of 0.06 inch in the area 30.

A tape 24 comprising a 0.0035 inch thick backing of polyester film (polytetramethyleneterephthalate) 1.625 inch long by 0.75 inch wide is adhered over the opening by a linear thermoplastic segmented polyester adhesive such as that designated "Dyvax PB722" which is commercially available from E. I. duPont de Nemours. A 0.875 inch wide by 1.5 inch long sheet 34 of an 0.00075 inch thick composite film comprising a layer of polyethyleneterephthalate and a layer of a polyethylene terephthalate/polyethyleneisophthalate copolymer (with respective monomer ratios ranging from 60/40 to 80/20) is adhered over the opening 16 and inner surface of the can end 12 by the same adhesive with the layer having the monomer ratio of 80/20 adjacent the tape 24.

The resultant container end assembly can withstand an internal can pressure of at least 90 pounds per square inch over atmospheric pressure without fracture and requires only about a 5 to 10 pound pull to peel the tape away from the opening 16. After the tape is peeled away from the opening 16, a pull of over 40 pounds is required to pull the tape 24 free of the bent tongue 18.

Alternate Embodiments

Figure 8:
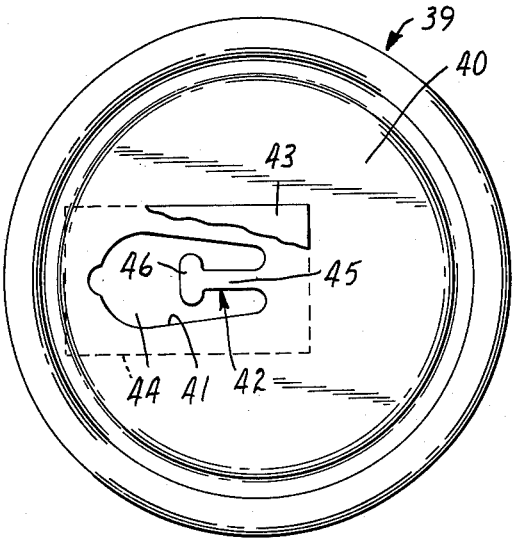
FIGS. 8, 9, 10 and 12 are fragmentary plan views of alternate ambodiments of a container end assembly according to the present invention, with the major parts of tapes in the assemblies broken away to show details of their tongue-like portions.

FIG. 8 illustrates a first alternate embodiment 39 of a can end assembly according to the present invention which embodiment 39, like the can end assembly 10, comprises a can end 40 having a generally U-shaped cut 41 defining three sides of an openable aperture therein and including a necked tongue-like portion 42 projecting between the sides and toward the base of the U-shaped cut 41; a tape 43 (only a fragment of which is shown) adhered to the exterior surface of the container end circumjacent and completely covering the U-shaped cut 41 which is peelable from the can end 40 starting at the end of the tape 43 adjacent the base of the U-shaped cut 41; and a sheet 44 adhered to the interior surface of the container end 40 circumjacent and completely covering the U-shaped cut 41 with portions of the sheet 44 around the tongue-like portion 42 adhered to the adjacent surface of the tape 43 through an opening in the can end 40. The tongue-like portion 42 differs from that of the can end assembly 10 in that it has a uniform width in its necked portion 45 between its distal part 46 and its proximal end and is thereby more easily bendable as the tape 43 is peeled away.

Figure 9:
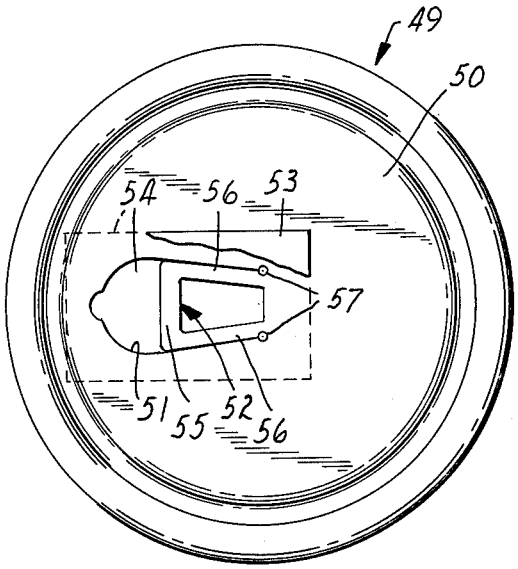

FIG. 9 illustrates a second alternative embodiment 49 of a can end assembly according to the present invention which embodiment 49, like the other embodiments described, also comprises a container end 50 having a generally U-shaped cut 51 defining three sides of an openable aperture therein and includes a tongue-like portion 52 projecting between the sides and toward the base of the U-shaped cut 51; a tape 53 (only a fragment of which is shown) adhered to the external surface of the container end 50 circumjacent and completely covering the U-shaped cut 51 which tape 53 is peelable from the can end 50 starting at the end of the tape 53 adjacent the base of the U-shaped cut 51; and a sheet 54 adhered to the interior surface of the container end 50 circumjacent and completely covering the U-shaped cut 51 with portions of the sheet 54 adhered to the adjacent surface of the tape 53 through openings in the container end 50. The tongue-like portion 52 differs from the tongue-like portions in the other embodiments described, in that it has a large distal end part 55 extending the entire width between the sides of the cut 51 to help attach the tongue-like portion to the tape 53, and two narrow rectangular parts 56 between its distal end part 55 and its proximal end along the side of the cut 51 which are sufficiently more narrow in total width than the distal end part 55 to afford bending of the tongue-like portion 52 with the tape 53 as the tape 53 is peeled away. Where this embodiment is used in pressurized containers the can end should have stress relief openings 57 at the ends of the cut 51 to reduce stress cracking of the container end from the internal pressure in the can.

Figure 10:
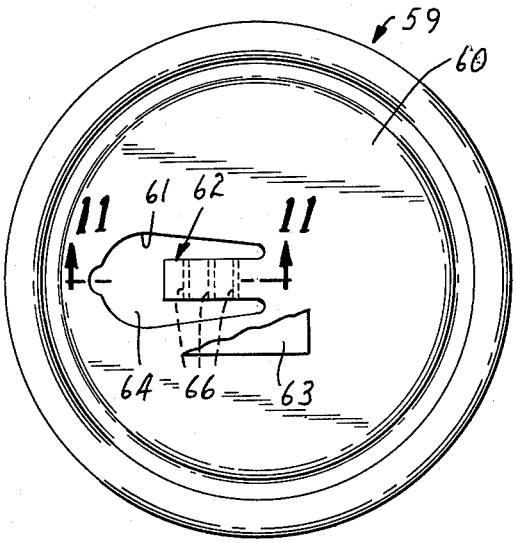
Figure 11:
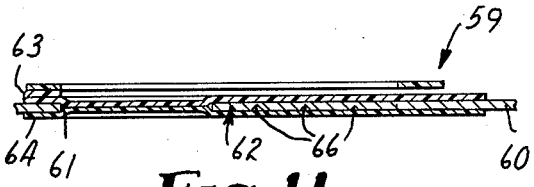
FIG. 11 is a fragmentary sectional view taken approximately along line 11—11 of FIG. 10.

FIGS. 10 and 11 illustrate a third alternative embodiment 59 of a can end assembly according to the present invention which embodiment 59, like the other embodiments described, also comprises a container end 60 having a generally U-shaped cut 61 defining three sides of an openable aperture therein and includes a tongue-like portion 62 projecting between the sides and toward the base of the U-shaped cut 61; a tape 63 (only a fragment of which is shown in FIG. 10) adhered to the external surface of the container end 60 circumjacent and completely covering the U-shaped cut 61 which tape 63 is peelable from the can end 60 starting at the end of the tape 63 adjacent the base of the U-shaped cut 61; and a thin sheet 64 adhered to the interior surface of the container end 60 circumjacent and completely covering the U-shaped cut 61 with portions of the sheet around the tongue-like portion 62 adhered to the adjacent surface of the tape 63 through an opening in the container end 60. The tongue-like portion 62 differs from the tongue-like portions in the other embodiments described in that it has a uniform width sufficient that adhesion between the tongue-like portion 62 and the tape 63 together with sandwiching of the tongue-like portion 62 between the tape 63 and the sheet 64 provides for attaching the tongue-like portion 62 to the tape 63 as the tape 63 is peeled away; and that it is reduced in thickness in transverse areas 66 spaced along its length so that it will bend with the tape 63 as the tape 63 is peeled away.

Figure 12:
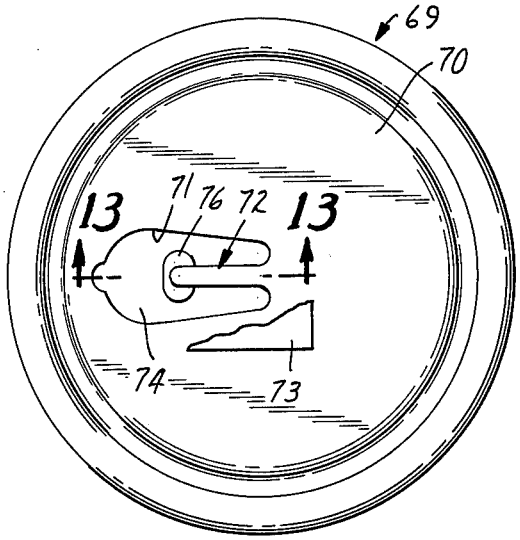
Figure 13:
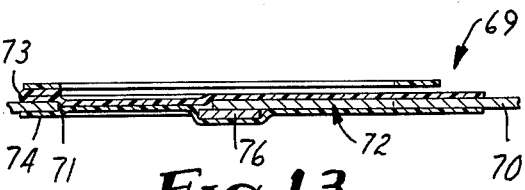
FIG. 13 is a fragmentary sectional view taken approximately along line 13—13 of FIG. 12.

FIGS. 12 and 13 illustrate a fourth alternative embodiment 69 of a can end assembly according to the present invention which embodiment 69, like the embodiments described above, also comprises a container end 70 having a generally U-shaped cut 71 defining three sides of an openable aperture therein and includes a tongue-like portion 72 projecting between the sides and toward the base of the U-shaped cut 71; a tape 73 (only a fragment of which is shown in FIG. 12) adhered to the external surface of the container end 70 circumjacent and completely covering the U-shaped cut 71 which tape 73 is peelable from the can end 70 starting at the end of the tape 73 adjacent the base of the U-shaped cut 71; and a sheet 74 adhered to the interior surface of the container end 70 circumjacent and completely covering the U-shaped cut 71 with portions of the sheet around the tongue-like portion 72 adhered to the adjacent surface of the tape 73 through an opening in the container end 70. The tongue-like portion 72 differs from the tongue-like portions in the other embodiments described, in that it has a uniform narrow width which allows it to bend back with the tape 73 along its entire length as the tape 73 is peeled away. The container end assembly 69 includes a stiff pad 76 of polymeric material between the edges of the cut 71 and between the sheet 74 and the distal end part of the tongue-like portion 72 which by adhesion of the tape 73 to the pad 76 and enclosing of the pad 76 between the tape 73 and the portion of the sheet 74 that remains on the tape 73 when it is peeled away, attaches the distal end part of the tongue-like portion 72 to the tape 73 causing it to stay with the tape 73 as the tape 73 is peeled away.

I claim:

1. A container end assembly comprising:

a container end of flexible sheet material which takes a permanent set when substantially folded, said container end having a generally U-shaped cut defining three sides of an openable aperture in the container end assembly and including a tongue-like portion projecting between the sides and toward the base of the U-shaped cut, said container end having a through opening defined by said U-shaped cut and said tongue-like portion;

a tape adhered to the exterior surface of the container end circumjacent and completely covering said U-shaped cut, the end of said tape adjacent the base of said U-shaped cut being unadhered and having a tab adapted for manual engagement, said tape being peelable from over the U-shaped cut by manually pulling the tab over the tape; and means for attaching the distal end part of the tongue-like portion to the tape to cause the distal end part to remain attached to the tape and for affording bending of the part of the tongue-like portion between its distal end part and its proximal end back with the tape during such peeling, the bent tongue-like portion taking a permanent set to hold the peeled tape closely adjacent the container end, and adhesion in shear between the tape and bent tongue-like portion restricting separation of the tape from the container end.

2. A container end assembly according to claim 1, wherein said means for attaching the distal end part of the tongue-like portion to the tape comprises a large distal end part on said tongue-like portion adhered to said tape, and said means for affording bending of the tongue-like portion comprises a portion of said tongue-like portion between said distal end part and its proximal end of a lesser width than said distal end part.

3. A container end assembly according to claim 2, wherein said container assembly further includes a sheet adhered to the interior surface of the container end circumjacent and completely covering said U-shaped cut with portions of the sheet around the tongue-like portion adhered to the adjacent surface of the tape through said opening, said sheet being adapted to separate at said U-shaped cut as said tape is peeled away and the portion of said sheet remaining on said tape and over said tongue-like portion as the tape is peeled away providing a portion of said means for attaching the distal end part of the tongue-like portion to the tape.

4. A container end assembly according to claim 1, wherein said container assembly further includes a sheet adhered to the interior surface of the container end circumjacent and completely covering said U-shaped cut with portions of the sheet around the tongue-like portion adhered to the adjacent surface of the tape through said opening, said sheet being adapted to separate at said U-shaped cut as said tape is peeled away and the portion of said sheet remaining on said tape and over said tongue-like portion as the tape is peeled away providing a portion of said means for attaching the distal end part of the tongue-like portion to the tape.

5. A container end assembly according to claim 1, further including a sheet adhered to the interior surface of the container end circumjacent and completely covering said U-shaped cut with portions of the sheet around the tongue-like portion adhered to the adjacent surface of the tape through said opening, said sheet being adapted to separate along said U-shaped cut as said tape is peeled away, and a stiff pad within the U-shaped cut and between said sheet and the distal end part of said tongue-like portion, said pad and the portion of said sheet remaining on said tape and over said tongue-like portion providing a portion of said means for attaching the distal end part of the tongue-like portion to the tape.

6. A container end assembly according to claim 1, wherein said means for attaching the distal end part of the tongue-like portion to the tape comprises a large distal end part on said tongue-like portion adhered to said tape, and said means for affording bending of the tongue-like portion comprises spaced portions of said tongue-like portion between said distal end part and its proximal end of a lesser thickness than said distal end part.

7. A container end assembly comprising:

a container end of flexible sheet material which takes a permanent set when substantially folded, said container end having a generally U-shaped cut defining three sides of an openable aperture in the container end assembly and including a necked tongue-like portion projecting between the sides and toward the base of the U-shaped cut, said container end having a through opening defined by said U-shaped cut and said tongue-like portion; and a tape adhered to the exterior surface of the container end circumjacent and completely covering said U-shaped cut, the end of said tape adjacent the base of the U-shaped cut being unadhered and having a tab adapted for manual engagement;

said tape being peelable from over the U-shaped cut to open the aperture by manually pulling the tab over the tape, the distal end part of the tongue-like portion causing it to remain adhered to the tape and the neck part of the tongue-like portion permitting the tongue-like portion to bend back with the tape during such peeling, the bent tongue-like portion taking a permanent set to hold the peeled tape closely adjacent the container end, and adhesion in shear between the tape and bent tongue-like portion restricting separation of the tape from the container end.

8. A container end assembly comprising:

a container end of flexible sheet material which takes a permanent set when substantially folded, said container end having a generally U-shaped cut defining three sides of an openable aperture in the container end assembly and including a necked tongue-like portion projecting between the sides and toward the base of the U-shaped cut, said container end having a through opening defined by said U-shaped cut and said tongue-like portion;

a tape adhered to the exterior surface of the container end circumjacent and completely covering said U-shaped cut, the end of said tape adjacent the base of the U-shaped cut being unadhered and having a tab adapted for manual engagement, said tape being peelable from over the U-shaped cut to open the aperture by manually pulling the tab over the tape; and a sheet adhered to the interior surface of the container end circumjacent and completely covering said U-shaped cut with portions of the sheet around the tongue-like portion adhered to the adjacent surface of the tape through said opening, said sheet being adapted to separate along said U-shaped cut as said tape is peeled away;

adhesion of the distal end part of the tongue-like portion to the tape and the portion of said sheet remaining on said tape and over said tongue-like portion when the tape is peeled away attaching the distal end part of the tongue-like portion to the tape and the neck part of the tongue-like portion permitting the tongue-like portion to bend back with the tape during such peeling, the bent tongue-like portion taking a permanent set to hold the peeled tape closely adjacent the container end, and adhesion in shear between the tape and bent tongue-like portion restricting separation of the tape from the container end.

9. A can end assembly comprising:

a can end of flexible sheet metal which takes a permanent set when substantially folded, said can end having a generally U-shaped cut defining three sides of an openable aperture in the can end assembly and including a necked tongue-like portion projecting between the sides and toward the base of the U-shaped cut, said container end having a through opening defined by said U-shaped cut and said tongue-like portion;

a tape adhered to the exterior surface of the can end circumjacent and completely covering said U-shaped cut, the end of said tape adjacent the base of the U-shaped cut being unadhered and having a tab adapted for manual engagement, said tape being peelable from over the U-shaped cut to open the aperture by manually pulling the tab over the tape; and a sheet adhered to the interior surface of the can end circumjacent and completely covering said U-shaped cut with portions of the sheet around the tongue-like portion adhered to the adjacent surface of the tape through said opening, said sheet being adapted to separate along said U-shaped cut as said tape is peeled away;

adhesion of the distal end part of the tongue-like portion to the tape and the portion of said sheet remaining on said tape and over said tongue-like portion when the tape is peeled away attaching the distal end part of the tongue-like portion to the tape and the neck part of the tongue-like portion permitting the tongue-like portion to bend back with the tape during such peeling, the bent tongue-like portion taking a permanent set to hold the peeled tape closely adjacent the container end, and adhesion in shear between the tape and bent tongue-like portion restricting separation of the tape from the can end.

10. A container end assembly comprising:

a container end of flexible sheet material which takes a permanent set when substantially folded, said container end having a cut defining three sides of an openable aperture in the container end assembly and including a tongue-like portion projecting between opposite sides of the cut, said container end having a through opening defined by said cut and said tongue-like portion;

a tape adhered to the exterior surface of the container end circumjacent and completely covering said cut, the end of said tape toward which said tongue-like portion projects being unadhered and having a tab adapted for manual engagement, said tape being peelable from over the cut by manually pulling the tab over the tape; and means for attaching the distal end part of the tongue-like portion to the tape to cause the distal end part to remain attached to the tape and for affording bending of the part of the tongue-like portion between its distal end part and its proximal end back with the tape during such peeling, the bent tongue-like portion taking a permanent set to hold the peeled tape closely adjacent the container end, and adhesion in shear between the tape and bent tongue-like portion restricting separation of the tape from the container end.

11. A container end assembly according to claim 10, wherein said means for attaching the distal end part of the tongue-like portion to the tape comprises a large distal end part on said tongue-like portion adhered to said tape, and said means for affording bending of the tongue-like portion comprises a portion of said tongue-like portion between said distal end part and its proximal end of a lesser width than said distal end part.

12. A container end assembly according to claim 10 or claim 11, wherein said container assembly further includes a sheet adhered to the interior surface of the container end circumjacent and completely covering said cut with portions of the sheet around the tongue-like portion adhered to the adjacent surface of the tape through said opening, said sheet being adapted to separate at said cut as said tape is peeled away and the portion of said sheet remaining on said tape and over said tongue-like portion as the tape is peeled away providing a portion of said means for attaching the distal end part of the tongue-like portion to the tape.

13. A container end assembly according to claim 10, further including a sheet adhered to the interior surface of the container end circumjacent and completely covering said cut with portions of the sheet around the tongue-like portion adhered to the adjacent surface of the tape through said opening, said sheet being adapted to separate along said cut as said tape is peeled away, and a stiff pad within the cut and between said sheet and the distal end part of said tongue-like portion, said pad and the portion of said sheet remaining on said tape and over said tongue-like portion providing a portion of said means for attaching the distal end part of the tongue-like portion to the tape.

14. A container end assembly according to claim 10, wherein said means for attaching the distal end part of the tongue-like portion to the tape comprises a large distal end part on said tongue-like portion adhered to said tape, and said means for affording bending of the tongue-like portion comprises spaced portions of said tongue-like portion between said distal end part and its proximal end of a lesser thickness than said distal end part.

* * * * *